US006054240A

United States Patent [19]

Julien et al.

[11] Patent Number: 6,054,240

[45] Date of Patent: Apr. 25, 2000

[54] TONER COMPOSITIONS AND PROCESSES THEREOF

[75] Inventors: Paul C. Julien, Webster; Sue E. Blaszak, Penfield; Edul N. Dalal, Webster; Kristen M. Natale-Hoffman, Rochester; Ronald J. Koch; John S. Berkes, both of Webster; Grazyna E. Kmiecik-Lawrynowicz, Fairport, all of N.Y.

[73] Assignee: Xerox Corporation, Stamford, Conn.

[21] Appl. No.: 09/282,314

[22] Filed: Mar. 31, 1999

[51] Int. Cl.[7] ..... G03G 9/09

[52] U.S. Cl. ..... 430/106; 430/111

[58] Field of Search ..... 430/106

[56] References Cited

U.S. PATENT DOCUMENTS

| | | | |
|---|---|---|---|
| 5,135,832 | 8/1992 | Sacripante et al. | 430/106.6 |
| 5,204,208 | 4/1993 | Paine et al. | 430/137 |
| 5,264,314 | 11/1993 | Mahabadi et al. | 430/137 |
| 5,391,456 | 2/1995 | Patel et al. | 430/137 |
| 5,534,379 | 7/1996 | Dalal et al. | 430/106 |
| 5,554,480 | 9/1996 | Patel et al. | 430/137 |
| 5,707,769 | 1/1998 | Hagi et al. | 430/106 |
| 5,712,068 | 1/1998 | Dalal et al. | 430/106 |
| 5,723,245 | 3/1998 | Bertrand et al. | 430/106 |

FOREIGN PATENT DOCUMENTS

| | | | |
|---|---|---|---|
| 57-130043 | 8/1982 | Japan | 430/106 |
| 3-2764 | 1/1991 | Japan | 430/106 |
| 3-94270 | 4/1991 | Japan | 430/106 |

*Primary Examiner*—Roland Martin
*Attorney, Agent, or Firm*—John L. Haack

[57] ABSTRACT

A yellow toner including:

a resin, and a colorant comprising a mixture of a yellow pigment and a yellow dye, wherein the combined weight of the colorant is from about 1 to about 50 weight percent of the total weight of the toner, and wherein the chroma of developed toner is from about 90 to about 130 CIELAB units.

13 Claims, No Drawings

TONER COMPOSITIONS AND PROCESSES THEREOF

REFERENCE TO ISSUED PATENTS

Attention is directed to commonly owned and assigned U.S. Pat. No. 5,723,245, to Bertrand et al., issued Mar. 3, 1998, which patent discloses a combination of toners including a cyan toner, a magenta toner, a yellow toner, an orange toner, a green toner and a black toner, each of the toners containing resin and pigment wherein the pigment for the orange toner can be Orange 5, C.I. number 12075, and the pigment for the green toner can be Green 7, C.I. number 74260, and wherein the pigment for each of the toners excluding black can be prepared by flushing processes; U.S. Pat. No. 5,712,068, to Dalal, et al., issued Jan. 27, 1998, which patent discloses toners comprised of a cyan toner, a magenta toner, a yellow toner, a green toner, and a black toner, each of the toners being comprised of resin and pigment; and wherein the pigment for the green toner is Green 7, C.I. Number 74260, or Green 36, C.I. Number 74265, and wherein the pigment, excluding black, is dispersed in the resin by flushing, wherein a cyan, magenta, green, and yellow pigment water wet cake is mixed with toner resin, and the water is substantially removed to generate pigmented resin; and U.S. Pat. No. 5,534,379, to Dalal, et al., issued Jul. 9, 1996, which patent discloses toner compositions formed by selecting a portion of at least one metal-containing pigment or dye and a portion of at least one metal-free pigment or dye, at least one pigment or dye containing a regulated metal and/or material and at least one pigment or dye containing a non-regulated metal and/or material, at least two pigments or dye each containing a different regulated metal and/or material, or pigments or dyes which contain different regulated metals and/or materials in different concentrations to provide required toner properties while maintaining metal, regulated metal and/or regulated material content of a toner composition below a prescribed level, and dispersing the pigments together in the composition.

The disclosures of each the above mentioned patents are incorporated herein by reference in their entirety. The appropriate components and processes of these patents may be selected for the toners and processes of the present invention in embodiments thereof.

BACKGROUND OF THE INVENTION

The present invention is generally directed to high fidelity color toner compositions and processes thereof. More specifically, the present invention is directed to processes from forming colored toners and developed images therefrom and which toners and images possess high color fidelity properties, for example, maximized chroma while minimizing pigment loading and deleterious effects associated therewith on the physical properties of the toner and toner images, for example, conductivities, resin reinforcement, image fix, image gloss, fuser roll loading, and the like concerns.

A problematical requirement of pigmented toners, and particularly of pigmented toners with small average particle sizes, for example, from about 1.0 to about 10.0 microns, is that high pigment loading, for example, from about 10 to about 20 weight percent pigment of the total weight of the toner composition, is required to achieve high chroma values. However, high pigment loading is accompanied by a host of problems which can adversely impact the properties of either or both the toner particles and toner images thereof.

A collateral problem associated with aforementioned high pigment loading is the difficulty of satisfactorily dispersing the pigment in the toner resin. This leads to unwanted absorption bands, inferior color quality, increased image scatter, lower chroma, poor transparency projection quality and the like problems.

Another major problem encountered with toners at high pigment loading is a phenomena known in the art as "resin reinforcement", which refers to very high toner melt viscosity that is imparted to the toner matrix and is believed to result from mechanical reinforcement of the resin by the pigment particles. Since resin reinforcement is a function of pigment loading, resin reinforcement occurs whether the toner is prepared by, for example, conventional comminutive processing or where prepared by toner particle growth schemes, also known as "chemical toner" processes, such as emulsion aggregation, when the pigment loading exceeds about 10 weight percent of the total weight of the toner. Resin reinforcement leads to the aforementioned deleterious effects. For fine toners, for example, with a number average particle size diameter of from about 2 to about 8 microns, desired for high fidelity color imaging, high pigment loadings, for example, from about 20 to about 30 weight percent, are believed necessary to achieve adequate color saturation at reduced toner pile heights and toner mass per unit areas. Thus, for 3 micron toners, for example, pigment loadings of about 20 weight percent and above are indicated. A way to avoid the reinforcing properties of pigments is to substitute a dye compound for the pigment. In this approach however, high dye loading or levels can plasticize the resin and can produce lower glass transition temperatures and corresponding lower blocking temperatures.

The aforementioned problems are unsatisfactory for black-and-white electrostatographic and especially color applications. The present invention overcomes the aforementioned problems.

The compositions and development processes of the present invention are useful in many electrostatographic applications, for example, in xerographic printers and copiers, and especially in color xerographic systems.

PRIOR ART

U.S. Pat. No. 5,707,769, issued Jan. 13, 1998, to Hagi, et al., which patent discloses a negatively chargeable color toner for full-color image forming, comprising a specific linear polyester resin and C.I. Solvent Yellow 162 or a specific anthraquinone magenta dye or an anthraquinone magenta dye together with a quinacridone magenta pigment.

U.S. Pat. No. 5,204,208, to Paine et al., issued Apr. 20, 1993, which patent discloses a process for obtaining custom color toner compositions which comprises admixing at least two encapsulated toners wherein each toner is comprised of a core comprised of a polymer binder, pigment, dye, or mixtures thereof, and a polymeric shell; and wherein the pigment, dye, or mixtures thereof is different for each toner, thereby resulting in a toner with a color different than each of the encapsulated toners.

U.S. Pat. No. 5,135,832, to Sacripante et al., issued Aug. 4, 1992, which patent discloses a colored magnetic encapsulated toner composition comprised of a core comprised of a polymer binder, a colorless or light colored magnetic material, a color pigment, dye, or mixture thereof excluding black, and a whitening agent; and which core is encapsulated in a polymeric shell containing a metal oxide.

U.S. Pat. No. 5,391,456, to Hopper et al., issued Feb. 21, 1995, which patent discloses a custom colored toners prepared by emulsion/aggregation processes, where the colorants used are mixtures of several different pigments aggregated with latex to form toner particles with custom color.

U.S. Pat. No. 5,554,480, to Patel et al., issued Sep. 10, 1996, which patent discloses preparation of emulsion/aggregation toners where the colorants are the mixtures of regular and UV fluorescent pigments used to extend color gamut of xerographic toners.

U.S. Pat. No. 5,264,314, issued Nov. 23, 1993, to Mahabadi; et al., discloses a process for the preparation of toner compositions which comprises mixing at least one resin monomer with a polymerization initiator, a crosslinking component and a chain transfer component; effecting bulk polymerization until partial polymerization to near the onset of the gel-effect has been accomplished thereby forming an organic phase containing a partially polymerized component; mixing the aforementioned partially polymerized component organic phase with pigment or dye particles; dispersing the resulting organic phase in water containing a stabilizing component whereby there is obtained a suspension of toner particles in water; and polymerizing the toner suspension by heating.

Other patents of interest for color toner preparation and imaging include U.S. Pat. Nos. 5,392,456, and 5,688,626. The aforementioned references are incorporated in their entirety by reference herein.

SUMMARY OF THE INVENTION

Embodiments of the present invention, include:

Processes for maximizing toner image chroma of printed images while minimizing pigment loading, minimizing pigment-resin reinforcement, and minimizing toner particle melt viscosity;

Processes for preparing toners, including emulsion-aggregation, wherein there is obtained toners with high colorant loadings and high chroma properties while maintaining important physical properties and characteristics, such as melt, charge, and fuse properties of the toner in operative ranges;

A process for the preparation of toner comprising:

(i) blending a first aqueous colorant dispersion comprised of a pigment and an ionic or nonionic surfactant in water, a second aqueous colorant dispersion comprised of a water insoluble dye and an ionic or nonionic surfactant in water, with a latex emulsion comprised of resin particles, a nonionic surfactant, and a flocculant to aggregate the resin particles and colorant particles;

(ii) heating the resulting aggregated mixture at about or below the glass transition temperature (Tg) of the latex resin to form toner sized aggregates;

(iii) chemically or sterically stabilizing the toner sized aggregates;

(iv) heating the resulting stabilized toner sized aggregates at about or above the Tg of the latex resin, and thereafter maintaining the temperature in the range of from about 5° C. to about 50° C. above the Tg;

(v) adjusting the pH of the resulting mixture below about 4 with an aqueous acid; and (vi) optionally isolating, washing and drying the resulting toner particles;

A yellow toner comprising:

a resin, a colorant comprising a mixture of a yellow pigment and a yellow dye, and optional surface and internal additives, wherein the combined weight of the colorant is from about 1 to about 50 weight percent of the total weight of the toner, and wherein the chroma of developed toner is from about 90 to about 130 CIELAB units.

The above processes and toners are achieved by forming toner compositions comprising mixing at least one resin, and a colorant comprised of at least one pigment and at least one dye.

These and other embodiments are illustrated herein.

DETAILED DESCRIPTION OF THE INVENTION

The present invention provides toner compositions, processes for preparing, and imaging processes thereof, wherein there are realized improved color properties and performance properties, An exemplary toner of the present invention is a yellow toner comprising:

a resin, a colorant comprising a mixture of a yellow pigment and a yellow dye, and optional surface and internal additives, wherein the combined weight of the colorant can be, for example, from about 1 to about 50 weight percent, and preferably from about 4 to about 30 weight percent of the total weight of the toner, wherein the chroma of developed toner can be from about 90 to about 130 CIELAB units, and wherein the chroma values are achieved at typical toner deposition levels, that is developed toner mass per unit areas (TMA) of from about 0.1 mg/cm$^2$ to about 10 mg/cm$^2$, preferably from about 0.5 mg/cm$^2$ to about 5.0 mg/cm$^2$, and more preferably from about 0.4 mg/cm$^2$ to about 1.0 mg/cm$^2$.

The yellow pigment or pigments can be, for example, Pigment Yellow 17 (C.I. 21105), Pigment Yellow 14 (C.I. 21095), Pigment Yellow 97 (C.I. 11767), Pigment Yellow 74 (C.I. 21096), and the like pigments, and mixtures thereof, and the yellow dye or dyes can be, for example, Solvent Yellow 162 (C.I. not assigned), anionic yellow dyes such as Acid Yellow 153 (C.I. 19230), cationic yellow dyes such as Basic Yellow 12 (C.I. 48065), Disperse Yellow 31 (C.I. 48000), Direct Yellow 74 (C.I. 25130), and mixtures thereof. It is readily appreciated by one of ordinary skill in the art that the present invention is not limited to the aforementioned yellow pigments and dyes, rather they are illustrative and exemplary. In a preferred embodiment, the yellow pigment is Pigment Yellow 17, and similar yellow pigments, and the yellow dye is Neopen Yellow 075, and similar yellow dyes, and as illustrated herein. The pigment selected for present invention can comprise one or more pigments and can be present in the toner in an amount of from about 2 to about 15 percent based on the total weight of the toner, and the dye selected for the present invention can comprise one or more dye and can be present in an amount of from about 2 to about 15 percent based on the total weight of the toner. The combined weight of the colorant is preferably from about 15 to about 30 weight percent of the total weight of the toner. The pigment to dye ratio of the colorant can be about 100:1 to about 1:100, preferably from about 20:1 to about 1:10, and more preferably from about 5:1 to about 1:5. The resin can be any suitable and known resin material and mixtures thereof, for example, polyesters, sulfonated polyesters, styrene acrylates, styrene butadienes, and the like polymers, and mixtures thereof. A preferred resin is polyester latex resin as illustrated herein.

A notable aspect achieved by the present invention includes providing a toner wherein the colorant loading and colorant dispersion in the resin are maximized while the melt viscosity of the toner, that is the dynamic viscosity, is maintained at below from about 2,000 to about 4,000 poise at 40 rad/sec and 155° C., for example maintained at from about 100 to about 2,000 poise at 40 rad/sec and 155° C. Additionally, the aforementioned colorant loading and colorant dispersion in the resin can be maximized while the first scan glass transition temperature of the toner is maintained at above from about 58° C. to about 60° C.

In embodiments the present invention provides an imaging process comprising:

developing electrostatographic images with yellow toner particles comprised of a resin, and a colorant comprising a mixture of a yellow pigment and a yellow dye, wherein the combined weight of the colorant is from about 4 to about 30 weight percent of the total weight of the toner, and wherein the chroma of developed toner is from about 90 to about 130 CIELAB units at a toner mass per unit area of from about to about 0.05 mg/cm$^2$ to about 5 mg/cm$^2$.

When measured at 40 rad/sec and 155° C., the dynamic viscosity of the toner particles is at least about 2,000 poise less than the dynamic viscosity of toner particles with comparable chroma prepared from a mixture of the same resin or resins and the same pigment alone. The first scan glass transition temperature of the toner particles was more than about 4° C. higher than the first scan glass transition temperature of toners with comparable chroma properties prepared from a mixture of the same resin and the same dye. An important aspect of the present invention is that unacceptably high resin reinforcement and concomitant high melt viscosities of from about 3,000 to about 15,000 poise at 40 rad/sec and 155° C. are avoided, while also unacceptably low glass transition temperatures of about 40° C. to 58° C. are avoided, and thereby a toner with superior color image properties and unexpected physical and performance properties is enabled.

In embodiments the present invention provides a processes for the preparation of toner particles. A first preparative process, hereinafter referred to as the "surfactant stabilized process", comprises:

(i) blending a first aqueous colorant dispersion comprised of a pigment and an ionic or nonionic surfactant in water, a second aqueous colorant dispersion comprised of a water insoluble dye and an ionic or nonionic surfactant in water, with a latex emulsion comprised of resin particles, a nonionic surfactant, and a flocculant in an amount sufficient to aggregate the resin particles and colorant particles;

(ii) heating the resulting aggregated mixture at about or below the glass transition temperature (Tg) of the latex resin to form toner sized aggregates;

(iii) chemically or sterically stabilizing the toner sized aggregates, for example, by adding an aqueous surfactant solution, or alternatively, raising the pH of the mixture above about 4 with an aqueous base; for example, aqueous sodium hydroxide solution;

(iv) heating the resulting stabilized toner sized aggregates at about or above the Tg of the latex resin, and thereafter maintaining the temperature in the range of from about 5° C. to about 50° C. above the Tg;

(v) adjusting the pH of the resulting mixture below about 4 with an aqueous acid; and (vi) optionally isolating, washing and drying the resulting toner particles The flocculant can be, for example, known surfactants, such as an ionic surfactant of opposite charge polarity to the polarity of the ionic surfactant contained in the colorant dispersion, an inorganic salt, such as polyaluminium chloride, and mixtures thereof, and any other known flocculants in an amount sufficient to cause aggregation of the resin particles and colorant particles and as illustrated herein. The amount of flocculant is preferably determined experimentally and in view of the surface properties, such as such reactivities and surface areas, of the other components present in the mixture, and can be from about 0.01 to about 10 weight percent based on the total solids content of the emulsion mixture.

A second toner preparative process, hereinafter referred to as the "dispersant stabilized process", comprises:

(i) blending a first aqueous colorant dispersion comprised of a pigment and a sulfonated polyester in water, a second colorant dispersion comprised of a water insoluble dye and a sulfonated polyester in water, and a sulfonated polyester latex emulsion comprised of resin particles dispersed in water, (ii) adding to the resulting mixture a flocculant in an amount sufficient to aggregate the resin particles and colorant particles;

(iii) mixing while heating the aggregated mixture at or above the glass transition temperature (Tg) of the polyester resin to form toner sized aggregates; and (iv) optionally isolating, washing, and drying the resulting toner particles.

The aforementioned preparative processes produce chemical toner with enhanced color properties and which processes comprise the aggregation and fusion of a latex polymer or resin, a colorant, and optional additive particles into toner particles, and a colorant containing a mixture of a pigment and a dye components. The colorant is comprised of a mixture of a pigment and a dye, for example, Neopen Yellow 075 dye and Neopen Yellow 17 pigment at ratios of from about 100:1 to about 1:100, and more preferably from about 20:1 to about 1:10. The resulting toner particles possess enhanced color properties and the high colorant loadings of pigment and dye apparently do not adversely affect the melting, charging, and fusing properties of the toner.

Alternatively, the toners of the present invention can be prepared by a process comprising melt mixing a pigment, a dye, a resin, and optional internal additives in an extruder or similar device; attributing the resultant mixture to average particle sizes below about ten microns; classifying the toner particles; and optionally applying surface additives.

In other embodiments, the present invention provides a toner prepared by any of the aforementioned preparative processes wherein the colorant is a mixture of a yellow pigment and a yellow dye in an amount of from about 4 to about 30 weight percent of the total weight of the toner wherein there is a pigment to dye ratio of the colorant of from about 100:1 to about 1:100, wherein the resin is polyester latex resin, wherein the melt viscosity of the toner is from about 100 to about 2,000 poise at 40 rad/sec and 155° C., and wherein the chroma of developed toner is from about 90 to about 130 CIELAB units at a developed toner mass per unit area of from about 0.05 mg/cm$^2$ to about 5 mg/cm$^2$.

The toner compositions resulting from the aforementioned preparative processes, surfactant and dispersant stabilized processes, respectively, can be optimized for the desired color properties depending on a final toner application. The resulting toners posses excellent colorant dispersions which in turn provide significantly improved projection efficiency and high color saturation properties at pigment concentrations which are considerably lower than those employed in conventional toners that achieve comparable properties. The toner compositions also possess, for example, a volume average diameter of from about 1 to about 25 microns, and preferably from about 3 to about 10 microns in volume average diameter, with a narrow particle size distribution as characterized by GSD of, for example, less than 1.35, and preferably less than about 1.25, and more specifically, from about 1.12 to about 1.25 as measured with a Coulter Counter, and which toners can enable improved color quality including hue and chroma and overhead projection efficiency of greater than about 75 percent. The toners can enable improved image fusing, that is for example, fusing of the image can be accomplished at a low temperature, for example, with a toner Minimum Fix Temperature (MFT) of from about 130° C. to about 160° C., as compared to toners prepared from pigment colorant only which possess a MFT of from about 160° C. to about 200° C., and wherein the invention toners possess excellent triboelectrical charging characteristics with a toner tribo of from about 20 $\mu$C/gram to about 40 $\mu$C/gram (microcoulombs per gram) at 50 percent relative humidity, as compared, for example, to toners prepared from pigments only that possess in a number of instances a low toner tribo of from about 10 $\mu$C/gram to about 15 $\mu$C/gram at 50 percent relative humidity; and acceptable gloss, for example with a gloss of from about 20 GGU (Gardner Gloss Units) up to about 70 GGU as measured by Gardner Gloss meter matching of the toner and paper after fixing the toner to paper substrates. The resulting toners can be selected for known electrophotographic imaging and printing processes, including digital color processes.

Advantages of the present invention illustrated herein include excellent stable triboelectric characteristics, acceptable stable admix properties, superior color resolution, the capability of obtaining virtually any color desired, that is a full color gamut, for example, thousands of different colors and different developed color images, substantial toner insensitivity to relative humidity, toners that are not substantially adversely affected by environmental changes of temperature, humidity, and the like, the provision of separate toners, such as black, cyan, magenta, green, and yellow toners, and mixtures thereof with the advantages illustrated herein, and which toners can be selected for the spot and multicolor development of electrostatic images. The specific selection of colored toners together with exceptionally well dispersed pigments provides, for example, a smooth fused image surface and enables a large color gamut which assures that thousands of colors can be produced. The toner compositions of the present invention usually contain surface additives and may also contain charge additives, waxes, such as polypropylene, polyhydroxy compounds, or polymeric alcohols, such as the UNILINS®, reference U.S. Pat. No. 4,883,736, the disclosure of which is totally incorporated herein by reference, and which UNILINS® are available from Petrolite Chemicals. The aforementioned alcohols are in embodiments of the present invention selected as components for dispersing the pigments.

Certain toner and developer compositions are known, including toners with specific pigments, such as yellow pigments such as diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. Moreover, toners with certain colored pigments are illustrated in U.S. Pat. No. 5,262,264, the disclosure of which is totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions; U.S. Pat. No. 4,221,856, discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide; and similar teachings are presented in U.S. Pat. No. 4,291,112, wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Further, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Moreover, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, of interest are U.S. Pat. Nos. 5,262,264 and 5,437,949, the disclosures of which are totally incorporated herein by reference.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

COMPARATIVE EXAMPLE I

Yellow Pigmented Toner

A toner was prepared in accordance with U.S. Pat. No. 5,688,626, containing the yellow pigment PY 17 at a loading of 8% by weight. This toner was developed in a laboratory fixture onto smooth white paper and the color of this sample was measured with an X-Rite 938 spectrodensitometer, using D50 illuminant and CIE 2-degree observer. At a toner mass of 0.2 mg/cm$^2$, the color of this sample according to the CIE system was L*=96.1, C*=91.5 and h*=96.5. The dynamic viscosity of this toner was separately measured over a range of temperatures. At a shear rate of 40 rad/sec and a temperature of 155° C., the dynamic viscosity of this toner was 1,595 poise. The first scan glass transition temperature was 66.1° C. The color of this toner was considered too weak at a toner mass of 0.2 mg/cm$^2$, specifically, the chroma (C*) was too low. The viscosity of the toner was considered adequate for the given roll fusing application. The glass transition temperature was sufficiently high to prevent blocking problems.

COMPARATIVE EXAMPLE II

Yellow Pigmented Toner

A toner was prepared in accordance with Comparative Example I, with the exception that the yellow pigment PY 17 was at a loading of 17.5 weight percent. At a toner mass of 0.2 mg/cm$^2$, the color of this sample according to the CIE system was L*=94.9, C*=107.1, and h*=94.0. At a shear rate of 40 rad/sec and a temperature of 155° C., the dynamic viscosity of this toner was 6,950 poise. The first scan glass transition temperature was 65.0° C. The color of this toner was considered to be adequate at a toner mass of 0.2 mg/cm$^2$. The glass transition temperature was sufficiently high to prevent blocking problems. However, the viscosity of the toner was too high for a roll fusing application because of the high pigment loading.

COMPARATIVE EXAMPLE III

Yellow Dyed Toner

A toner was prepared in accordance with Comparative Example I, with the exception that the colorant consisted of only yellow dye Neopen Yellow 075 at a loading of 24% by weight. At a toner mass of 0.2 mg/cm$^2$ the color of this sample according to the CIE system was L*=94.7, C*=114.8, and h*=94.0. At a shear rate of 40 rad/sec and a temperature of 155° C., the dynamic viscosity of this toner was 200 poise. The first scan glass transition temperature was 56.0° C. The color of this toner was considered to be adequate at a toner mass of 0.2 mg/cm$^2$. The viscosity of the toner was considered low for this roll fusing application but this is not an insurmountable problem since the fuser could be run at lower temperatures. However, because of the high dye loading, the glass transition temperature was lowered to the extent that the toner had inadequate blocking resistance.

EXAMPLE I

Yellow Dye+Pigment Toner

A toner was prepared in accordance with Comparative Example I, with the exception that the colorant consisted of yellow pigment PY 17 at a loading of 8% by weight and yellow dye Neopen Yellow 075 at a loading of 12% by weight. At a toner mass of 0.2 mg/cm$^2$ the color of this sample according to the CIE system was L*=95.0, C*=116.3 and h*=93.8. At a shear rate of 40 rad/sec and a temperature of 155° C., the dynamic viscosity of this toner was 1,310 poise. The first scan glass transition temperature was 61.6° C. The color quality of this toner at a toner mass of 0.2 mg/cm$^2$ was as good as the toners in Comparative Examples II and III. However, the viscosity of the toner was similar to that of Comparative Example I, which was adequate for the given roll fusing application, and the glass transition temperature was similar to Comparative Example I thereby providing adequate blocking characteristics.

Other modifications of the present invention may occur to one of ordinary skill in the art based upon a review of the present application and these modifications, including equivalents thereof, are intended to be included within the scope of the present invention.

What is claimed is:

1. A yellow toner comprising:

a resin, and a colorant comprising a mixture of a yellow pigment in an amount of from about 2 to about 15 percent and a yellow dye in an amount of from about 2 to about 15 percent based on the total weight of the toner, wherein the combined weight of the colorant is from about 15 to about 30 weight percent of the total weight of the toner, wherein the chroma of developed toner is from about 90 to about 130 CIELAB units at a toner mass per unit area from about 0.05 mg/cm$^2$ to about 5 mg/cm$^2$, wherein colorant loading and colorant dispersion in the resin is maximized while the dynamic viscosity of the toner is maintained at below from about 2,000 to about 4,000 poise at 40 rad/sec and 155° C., and wherein resin reinforcement is avoided.

2. A toner in accordance with claim 1, wherein the yellow pigment is selected from the group consisting of Pigment Yellow 17, Pigment Yellow 14, Pigment Yellow 97, Pigment Yellow 74, and mixtures thereof, and the yellow dye is selected from the group consisting of Solvent Yellow 16, Acid Yellow 153, Basic Yellow 12, Disperse Yellow 31, Direct Yellow 74, and mixtures thereof.

3. A toner in accordance with claim 1, wherein the resin is a polyester, sulfonated polyester, styrene acrylate, styrene butadiene, and mixtures thereof.

4. A toner in accordance with claim 1, wherein the weight of the colorant is from about 15 to about 30 weight percent of the total weight of the toner.

5. A toner in accordance with claim 1, wherein colorant loading and colorant dispersion in the resin are maximized while the first scan glass transition temperature of the toner is maintained at above from about 58° C. to about 60° C.

6. A toner in accordance with claim 1, wherein the pigment to dye ratio of said colorant is about 100:1 to about 1:100.

7. A toner in accordance with claim 1, further comprising optional additives selected from the group consisting of surface additives and internal additives.

8. An imaging process comprising:

developing electrostatographic images with yellow toner particles comprised of a resin, and a colorant comprising a mixture of a yellow pigment and a yellow dye, wherein the combined weight of the colorant is from about 4 to about 30 weight percent of the total weight of the toner, and wherein the chroma of developed toner is from about 90 to about 130 CIELAB units at a toner mass per unit area of from about 0.05 $mg/cm^2$ to about 5 $mg/cm^2$.

9. A process in accordance with claim 8, wherein the dynamic viscosity of the toner particles at 40 rad/sec and 155° C. is at least 2,000 poise less than the dynamic viscosity of toner particles with comparable chroma prepared from a mixture of at least one resin and one pigment.

10. A process in accordance with claim 8, wherein first scan glass transition temperature of the toner particles is at least 4° C. higher than the first scan glass transition temperature of toner particles with comparable chroma properties prepared from a mixture of at least one resin and one dye.

11. A process in accordance with claim 8, wherein resin reinforcement, concomitant high melt viscosities of from about 3,000 to about 15,000 poise at 40 rad/sec and 155° C., and plasticization and concomitant low first scan glass transition temperatures of from about 40 to about 58° C. are all avoided.

12. A process in accordance with claim 8, wherein said at least one pigment is present in an amount of from about 2 to about 15 percent, wherein the dye is present in an amount of from about 2 to about 15 percent.

13. A toner in accordance with claim 1, wherein the toner particle size is from about from about 3 to about 10 microns in volume average diameter.

* * * * *